US005704997A

United States Patent [19]

Ouvrard et al.

[11] Patent Number: 5,704,997

[45] Date of Patent: Jan. 6, 1998

[54] PROCESS FOR PREPARING A STEEL STRIP AND NOVEL STEEL STRIP

[75] Inventors: Jacques Ouvrard, Nantes; Michel Chauvire, Coueron; Jean-Claude Jouvenel, Nantes, all of France

[73] Assignee: Sollac (Societe Anonyme), Puteaux, France

[21] Appl. No.: 576,368

[22] Filed: Dec. 21, 1995

[30] Foreign Application Priority Data

Dec. 21, 1994 [FR] France ..... 94 15 350

[51] Int. Cl.[6] ..... C21D 8/04; C22C 38/00

[52] U.S. Cl. ..... 148/320; 148/651

[58] Field of Search ..... 148/320, 651

[56] References Cited

FOREIGN PATENT DOCUMENTS

| | | | |
|---|---|---|---|
| 0524162 | 1/1993 | European Pat. Off. . | |
| 0 574 814 | 12/1993 | European Pat. Off. . | |
| 1438853 | 4/1966 | France . | |
| 2115285 | 7/1972 | France . | |
| 4319431 | 11/1994 | Germany . | |
| 404333525 | 11/1992 | Japan | 148/651 |
| 404350125 | 12/1992 | Japan | 148/651 |

*Primary Examiner*—Deborah Yee

*Attorney, Agent, or Firm*—Oblon, Spivak, McClelland, Maier & Neustadt, P.C.

[57] ABSTRACT

A steel strip and method for its production.

14 Claims, No Drawings

PROCESS FOR PREPARING A STEEL STRIP AND NOVEL STEEL STRIP

BACKGROUND OF THE INVENTION

1. Field of the Invention

The invention relates to a steel strip and to the manufacture of a steel strip, preferably a steel strip intended to be used in the fabrication, by deep drawing and re-drawing of steel containers. Both the production process and product make up the invention.

2. Discussion of the Background

In order to make steel boxes, and notably steel cans or containers meant to contain drinks, one typically uses cold rolled bands of steel with low carbon or ultra low carbon that are transformed by deep drawing and re-drawing. The bands are obtained from hot laminated rolled strips that are cold rolled a first time, then annealed and cold rolled a second time; the second cold rolling being performed in one run leads to a thickness reduction of 40%. The strips thus obtained have a thickness greater than or equal to 0.18 mm, a tensile strength of less than 600 MPa, and a satisfactory drawability characteristic.

However, in order to decrease the thickness of a steel container's walls fabricated by drawing and re-drawing, one tries to make cold rolled steel strips with thickness less than 0.18 mm and with a tensile strength of greater than 600 MPa. In order to achieve this, one either increases the reduction rate during the second cold rolling or increases the carbon or the manganese content in the steel. These two techniques have the drawback, however, of deteriorating the stamping characteristics of the bands such that they are not satisfactory.

OBJECTS OF THE INVENTION

One object of the present invention is to provide a steel strip and a process for preparing steel strips having good stamping drawability as well as a tensile strength greater than 600 MPa and a thickness that can be less than 0.18 mm. Other objects will become apparent by reference to the following detailed description.

DETAILED DESCRIPTION OF THE INVENTION

The present invention, which provides the above objects, is directed to steel strips and to a process for preparing a steel strip which can be used in the fabrication by drawing and re-drawing of steel containers, according to which:

an ultra-low ($C \leqq 0.01\%$ by weight) or low ($C \leqq 0.1\%$ by weight) carbon steel strip is supplied and hot-rolled under heat, a first cold rolling of the strip is done to obtain a rough form or blank, the rough form or blank is annealed, a second cold rolling is done in at least two runs.

During the second cold rolling, the thickness reduction is preferably at least 30%, preferably 35%, more preferably between 38% and 47%, and the annealing is preferably done between 600° C. and 700° C.; the annealing can be done continuously.

The second cold rolling can be done in two runs, and in this case, a thickness reduction of at least 25% is preferably used in the first run and a thickness reduction of at least 5% is preferably used during the second run.

A preferred ultra low carbon type steel for use herein has the following chemical composition by weight:

$C \leqq 0.006\%$ $Si \leqq 0.02\%$ $0.15\% \leqq Mn \leqq 0.35\%$ $S \leqq 0.015\%$ $P \leqq 0.015\%$ $N \leqq 0.006\%$ $0.02\% \leqq Al \leqq 0.06\%$, the remaining part being iron and impurities from production.

The invention also relates to an ultra low carbon steel strip which can be used, e.g., for the fabrication by drawing and re-drawing of steel containers, the steel strip preferably having:

a thickness less than 0.2 mm, a tensile strength greater than or equal to 600 MPa, an ear rate, C, between 0 and −0.4, an anisotropy coefficient, r, preferably close to 2 but between 1.5 and 2.5.

The strip thickness can be less than 0.17 mm.

The invention strip can be made of steel having a weight percent chemical composition so that:

$0.03\% \leqq C \leqq 0.06\%$ $Si \leqq 0.03\%$ $0.15 \leqq Mn \leqq 0.35\%$ $S \leqq 0.03\%$ $P \leqq 0.02\%$ $N \leqq 0.008\%$ $0.02\% \leqq Al \leqq 0.06\%$, the remaining part being iron and impurities coming from production.

In order to be better understood, the invention will now be described in more detail, but not in a limiting way.

The inventors discovered that when one uses steel of the ultra low carbon type to make a cold rolled strip, obtained from a hot rolled strip, cold rolled a first time, then annealed and then cold rolled a second time, the second cold rolling being done in two runs instead of one run, it is possible to obtain a lower thickness as well as a high mechanical resistance and good drawability characteristics.

Low thickness as used herein means less than 0.20 mm, and preferably less than 0.17 mm including 15, 12, 10, 8, 5 etc., mm; by high mechanical resistance, a tensile strength higher than 600 MPa, preferably higher than 650 MPa; by good drawability characteristics, an ear rate, C, between 0 and −0.4 and an anisotropy coefficient, r, between 1.5 and 2.5, preferably close to 2(i.e., ±15%, more preferably ±5%).

In order to make such a strip, it is preferred to use an ultra low carbon steel with a chemical composition by weight of:

$C \leqq 0.006\%$ $Si \leqq 0.02\%$ $0.15\% \leqq Mn \leqq 0.35\%$ $S \leqq 0.015\%$ $P \leqq 0.015\%$ $N \leqq 0.006\%$ $0.02\% \leqq Al \leqq 0.06\%$, the remaining part being iron and impurities coming from production.

Using ultra low carbon steel, one makes, according to known methods, a hot rolled strip which is then cold rolled, (blank), its thickness being between 0.2 and 0.3mm. This blank is then annealed, preferably continuously, between 600° C. and 700° C., preferably between 630° C. and 680° C. The annealed blank then undergoes a second cold rolling which is done in at least two runs and done by a continuous rolling mill. The reduction rate of the first run should be greater than 30% and the reduction rate of the second run should be greater than 5%; the total reduction rate should be between 35% and 50%, and preferably between 40%and 45%. Thus, one obtains cold rolled strips particularly suitable for the fabrication, by drawing and re-drawing, of steel containers, preferably of the drink can type, with the characteristics indicated above.

EXAMPLES

A strip of 0.16 mm thickness was made according to the invention process with a steel of the following chemical composition by weight:

C=0.002%
Si=0.003%
Mn=0.208%
S=0.012%
P=0.01%
N=0.005%
Al=0.025%, the remaining part being iron and impurities coming from production.

The annealing was done at 650° C.; during the second cold rolling, the reduction rate of the first run was 30% and the rate of the second run was 10%.

The strip tensile strength was 675 MPa, the ear rate, measured by the magnetic anisotropy method, was −0.36, and the anisotropy coefficient, r, measured by the texture RX method was 2.01.

As a second example, a strip of 0.16 mm thickness was made according to the invention process with a steel of the following chemical composition by weight:

C=0.002%
Si=0.002%
Mn=0.218%
S=0.009%
P=0.006%
N=0.005%
Al=0.027%, the remaining part being iron and impurities coming from production.

The annealing was done at 650° C.; during the second cold rolling, the reduction rate of the first run was 30% and the rate of the second run was 8%.

The strip tensile strength was 635 MPa, the ear rate, measured by the magnetic anisotropy method, was −0.25, and the anisotropy coefficient, r, measured by the texture RX method was 2.

As a third example, a strip of 0.16 mm thickness was made according to the invention process with a low carbon steel of the following chemical composition by weight:

C=0.03%
Si=0.009%
Mn=0,197%
S=0.012%
P=0.01%
N=0.006%
Al=0.022%, the remaining part being iron and impurities coming from production.

The annealing was done at 650° C.; during the second cold rolling, the reduction rate of the first run was 20% and the one of the second run was 10%.

The strip tensile strength was 626 MPa, the ear rate, measured by the magnetic anisotropy method, was −0.42, and the anisotropy coefficient, r, measured by the texture RX method was 1.5.

COMPARISON EXAMPLES

For comparison purposes, a 0.16 mm thick strip was made according to the prior art with a steel of the following chemical composition by weight:

C=0.002%
Si=0.003%
Mn=0.208%
S=0.012%
P=0.01%
N=0.005%
Al=0.03%, the remaining part being iron and impurities coming from production.

The annealing was done at 650° C.; the second cold rolling was done in one single run with a reduction rate of 45%.

The strip tensile strength was 599 MPa, the ear rate, measured by the magnetic anisotropy method, was −0.34, and the anisotropy coefficient, r, measured by the texture RX method was 2.09.

Also for comparison purposes, a 0.16 mm thick strip was made according to the prior art, with a steel of the following chemical composition by weight:

C=0.035%
Si=0.09%
Mn=0.197%
S=0.12%
P=0.01%
N=0.006%
Al=0.021%, the remaining part being iron and impurities coming from production.

The annealing was done at 650° C.; the second cold rolling was done in a single pass with a reduction rate of 30%.

The strip tensile strength was 599 MPa, the ear rate, measured by the magnetic anisotropy method, was −0.46, and the anisotropy coefficient, r, measured by the texture RX method was 1.5.

The examples according to the invention combine traction tensile strength ear rates and anisotropy coefficients that show very well the advantage of the invention compared to the examples of the prior art given for comparison purposes.

This application is based on French Application 94 15350 filed Dec. 21, 1994, incorporated herein by reference.

What is claimed as new and desired to be secured by Letters Patent of the United States is:

1. A process for producing a steel strip comprising the steps of:

supplying an ultra-low or low carbon steel hot-rolled strip having carbon content of at most 0.01% by weight, cold rolling the strip to obtain a blank, annealing the blank, cold rolling the annealed blank in at least two runs, to provide a steel strip having a tensile strength of greater than or equal to 600 MPa.

2. The process according to claim 1, wherein during the second cold rolling a thickness reduction of at least 35% is obtained.

3. The process according to claim 1, wherein during the cold rolling of the annealed rough form which is done in two runs a thickness reduction of at least 25% is obtained in the first run and a thickness reduction of at least 5% is obtained during the second run.

4. The process according to claim 1, wherein overall thickness reduction during the second cold rolling is between 38% and 47%.

5. The process according to claim 1, wherein the annealing is done between 600° C. and 700° C.

6. The process according to claim 1, wherein the annealing is done continuously.

7. The process according to claim 1, wherein the ultra low carbon steel strip has a chemical composition by weight of:

$C \leqq 0.006\%$ $Si \leqq 0.02\%$ $0.15\% \leqq Mn \leqq 0.35\%$ $S \leqq 0.015\%$ $P \leqq 0.015\%$ $N \leqq 0\ 006\%$ $0.02\% \leqq Al \leqq 0.06\%$, the remaining part being iron and impurities coming from production.

8. An ultra low or low carbon steel strip having:

a thickness of less than 0.2 mm, a tensile strength greater than or equal to 600 MPa, an ear rate, C, between 0 and −0.4, an anisotropy coefficient, r, between 1.5 and 2.5, and carbon content of at most 0.01% by weight.

9. The strip according to claim 8, wherein the width of the strip is less than 0.17 mm.

10. The strip according to claim 8, wherein the steel band has a chemical composition by weight of:

$C \leqq 0.006\%$ $Si \leqq 0.02\%$ $0.15\% \leqq Mn \leqq 0.35\%$ $S \leqq 0.015\%$ $P \leqq 0.015\%$ $N \leqq 0.006\%$ $0.02\% \leqq Al \leqq 0.06\%$, the remaining part being iron and impurities coming from production.

11. The process of claim 1, wherein said steel strip comprises 0.15% to 0.35% by weight Mn.

12. A steel strip produced by the process of claim 1, having a thickness of less than 0.2 mm.

13. The steel strip of claim 12, comprising 0.15% to 0.35% by weight Mn.

14. The steel strip of claim 8, comprising 0.15% to 0.35% by weight Mn.

* * * * *